US005246140A

United States Patent [19]

Thix et al.

[11] Patent Number: 5,246,140

[45] Date of Patent: Sep. 21, 1993

[54] CONTAINER DEVICE FOR DISTRIBUTING A DRINKABLE LIQUID UNDER PRESSURE FROM A GAS

[75] Inventors: André Thix, Troixvierges, Luxembourg; Bernt Ipsen, Morud, Denmark

[73] Assignee: Micro Matic A/S, Odense SV, Denmark

[21] Appl. No.: 989,881

[22] Filed: Dec. 11, 1992

Related U.S. Application Data

[63] Continuation of Ser. No. 623,993, Dec. 21, 1990, filed as PCT/DK89/00154, Jun. 22, 1989, published as WO89/12599, Dec. 28, 1989, abandoned.

[30] Foreign Application Priority Data

Jun. 23, 1988 [DK] Denmark ..... 3441/88

[51] Int. Cl.[5] ..... B67D 5/01

[52] U.S. Cl. ..... 222/4; 222/131; 222/399; 222/400.7

[58] Field of Search ..... 222/4, 131, 396, 399, 222/400.7, 402.18

[56] References Cited

U.S. PATENT DOCUMENTS

| | | | |
|---|---|---|---|
| 597,292 | 1/1898 | Lindner et al. | 222/396 |
| 635,678 | 10/1899 | Eckavdt | 222/399 |
| 1,099,925 | 6/1914 | Kleinfeldt et al. | 222/399 |
| 1,238,271 | 8/1917 | Crovo | 222/399 |
| 1,412,321 | 4/1922 | Tate | 222/399 |
| 2,090,403 | 8/1937 | Murray et al. | 222/396 |
| 2,164,172 | 6/1939 | Dalton | 222/399 |
| 2,501,611 | 3/1950 | Nicholson | 222/399 X |
| 2,732,977 | 1/1956 | Clavpiat | 222/131 |
| 2,939,611 | 6/1960 | Nebinger | 222/131 |
| 3,024,800 | 3/1962 | Lewis | 222/399 X |
| 3,152,730 | 10/1964 | Piker | 222/131 |
| 3,161,324 | 12/1964 | O'Neill | 222/396 |
| 3,243,085 | 3/1966 | Wilson | 222/396 |
| 3,286,884 | 11/1966 | Long, Jr. | 222/131 |
| 3,556,356 | 1/1971 | Mockesch | 222/399 |
| 3,976,221 | 8/1976 | Martin et al. | 222/399 X |
| 4,189,068 | 2/1980 | Apellaniz | 222/399 X |
| 4,274,562 | 6/1981 | Medeiros et al. | 222/131 |
| 4,402,429 | 9/1983 | VandenDriessche | 222/396 |
| 4,422,371 | 12/1983 | Child et al. | 99/323.1 |
| 4,473,174 | 9/1984 | Heuser | 222/399 X |
| 4,632,276 | 12/1986 | Makino | 222/399 X |
| 4,728,010 | 3/1988 | Johnston | 222/397 |
| 4,844,300 | 7/1989 | Simons et al. | 222/399 X |

FOREIGN PATENT DOCUMENTS

| | | | |
|---|---|---|---|
| 596843 | 4/1960 | Canada | 222/399 |
| 1155993 | 10/1963 | Fed. Rep. of Germany . | |
| 89846 | 4/1966 | France | 222/399 |
| 26505 | of 1896 | United Kingdom | 222/399 |
| 333809 | 8/1936 | United Kingdom | 222/399 |
| 976329 | 11/1964 | United Kingdom | 222/400.7 |
| 9102694 | 3/1991 | World Int. Prop. O. | 222/400.7 |

*Primary Examiner*—Andres Kashnikow
*Assistant Examiner*—Kenneth Bomberg
*Attorney, Agent, or Firm*—Oliff & Berridge

[57] ABSTRACT

A container device is used to distribute a preferably drinkable liquid, such as beer, wine, mineral water or juice, under pressure from a gas such as $CO_2$. The container device includes a liquid container with a combined gas and liquid valve and a coupling head which may be detachably coupled with the gas and liquid valve for dispensing liquid from the liquid container and adding gas via a reduction valve from a reservoir of liquified gas in a high pressure container. Without a noticeable increase in overall volume of the container device, the high pressure container can hold and carry a sufficient amount of gas for emptying liquid from the liquid container.

11 Claims, 7 Drawing Sheets

CONTAINER DEVICE FOR DISTRIBUTING A DRINKABLE LIQUID UNDER PRESSURE FROM A GAS

This is a continuation of application Ser. No. 07/623,993, filed Dec. 21, 1989, filed as PCT/DK89/00154, Jun. 22, 1989, published as WO89/12599, Dec. 28, 1989, now abandoned.

BACKGROUND OF THE INVENTION

The invention concerns a container device for distributing a preferably drinkable liquid, such as beer, wine, mineral water or juice, under pressure from a gas, e.g. $CO_2$, comprising a liquid container with a combined gas and liquid valve and a coupling head which may be detachably coupled with the gas and liquid valve for dispensing liquid from the liquid container and adding gas via a reduction valve from a reservoir of liquefied gas in a high pressure container.

Such containers, which are generally called casks or kegs, are widely used nowadays for distributing e.g. beer, which is maintained in the container under a $CO_2$ pressure of about 3 bar, with a view to keeping the beer fresh and giving it its special fizzy and foaming character. The container is opened by mounting on its valve a special coupling head which is in turn connected with a dispensing valve via a line. During dispensing the gas now also acts as a propellant gas, which however follows the beverage out of the container to a certain extent. To remedy the adverse consequences of this, it is necessary successively to supplement the gas content of the container with new gas as the beverage is dispensed, and with the present state of the art this takes place by connecting the gas inlet of the coupling head via a reduction valve with a separate bottle or with disposable cartridges in which the gas is present in a liquefied state. This is cumbersome and time consuming in any event, and in particular when bottles are used, requiring relatively complicated connections, while on the other hand the costs are increased considerably when cartridges are used instead, since emptying of just one container takes several cartridges which will then have to be discarded afterwards.

It has been attempted to remedy these drawbacks by arranging an additional chamber upwardly in an otherwise conventional beverage container by means of a partition. The consumer then fills this chamber in advance with sufficient gas for emptying the container of the beverage. This essentially solves the above-mentioned problems since the user no longer has to use separate gas bottles or cartridges, but owing to the excessively great volume of the gas this new type of container takes up much more room than previously, which adds to the transport and handling costs.

Further, the U.S. Patent Specification No. 3 243 085 discloses a dispensing container having a gas pressure container therein. However, this gas pressure container is a separate part which is insertable into and removable from the dispensing container; therefore, it does not have the advantages which are associated with the above-mentioned known beverage container where the gas chamber constitutes an integral part of the beverage container.

The object of the invention is therefore to provide a container device of the type mentioned in the opening paragraph, which itself can contain the necessary gas amount for emptying the beverage without noticeable increase in the total volume of the container, and which is also easier and quicker to mount when it is to be used, than known before.

This is obtained in that the container device of the invention is characterized in that at least a high pressure container for liquefied gas constitutes a component integral with the liquid container, whereby the transportable container can hold sufficient gas for emptying without its overall volume being noticeably increased since the gas in liquified form only has a very small volume.

According to the invention, the high pressure container may be a cylinder or ring shaped pressure container which is secured to the liquid container by means of joining method, such as welding, soldering, seaming or screwing. The transport container is hereby divided into two chambers, one of which is a low pressure chamber for the liquid and the other a high pressure chamber for the liquefied gas.

In a preferred embodiment, the high pressure container may moreover according to the invention be a cylinder or ring-shaped pressure container, which is embedded in a jacket of e.g. foam plastics which surrounds the liquid container and is firmly connected with it, so that the high pressure chamber and its boundaries will be disposed completely outside the low pressure chamber, which is thus easier to clean.

Moreover, according to the invention, the container device may comprise one or more high pressure containers, each of which is adapted to a pressure of at least 60 bar, and the product of this pressure and the containers, volume in liters may be less than 250 liter bars, preferably less than 200 liter bars. The gas can hereby be contained in a liquefied state without the high pressure container or high pressure containers being subjected to official and repeated testing and approval requirements, since the sufficient gas amount for emptying the container of liquid is divided, if necessary, between several high pressure containers of this type.

Further, according to the invention, the reduction valve may form a component integral with the liquid container, so that mounting is facilitated considerably when the container is to be used.

Finally, the outlet opening of the reduction valve and the gas and liquid valve may be positioned with mutual axis-spacing, and the coupling head may be equipped with a dispensing valve for the liquid and also be so adapted that in mounted state it partly connects the reduction valve with the gas inlet of the gas and liquid valve, partly connects the dispensing valve with the liquid outlet of the gas and liquid valve. This means that the coupling head may be mounted on the transport container in a single operation, which at the same time establishes all the necessary gas and liquid connections for operating the container device and dispensing the liquid.

BRIEF DESCRIPTION OF THE DRAWINGS

The invention will be explained more fully by the following description of preferred embodiments, which are given by way of example and form no limitation in the scope of protection of the invention, with reference to the drawing, in which.

Figure 1:
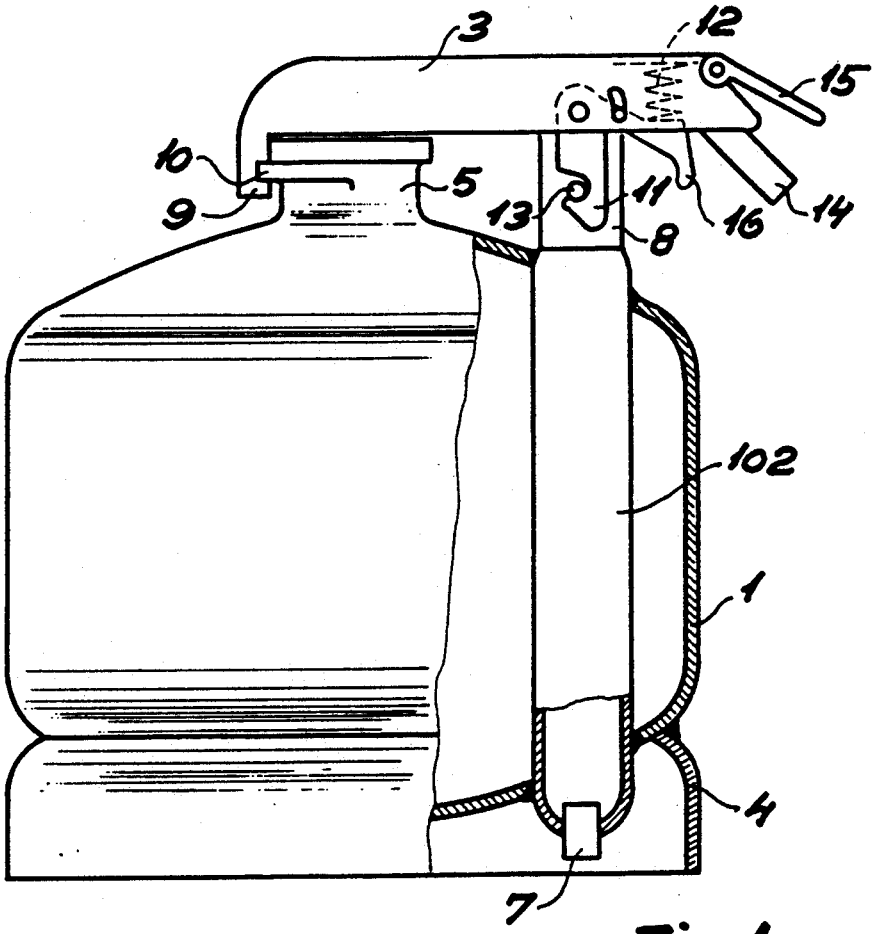
FIG. 1 is a lateral, partially sectional view of a first embodiment of a container device of the invention.

In the Figures, which show the various embodiments of the container device of the invention described more fully below, the same parts are indicated by the same reference numbers, while alternatively constructed parts having the same function are indicated by the same reference numerals, but with a prefixed figure corresponding to the respective embodiment.

DETAILED DESCRIPTION OF THE PREFERRED EMBODIMENTS

Figure 6:
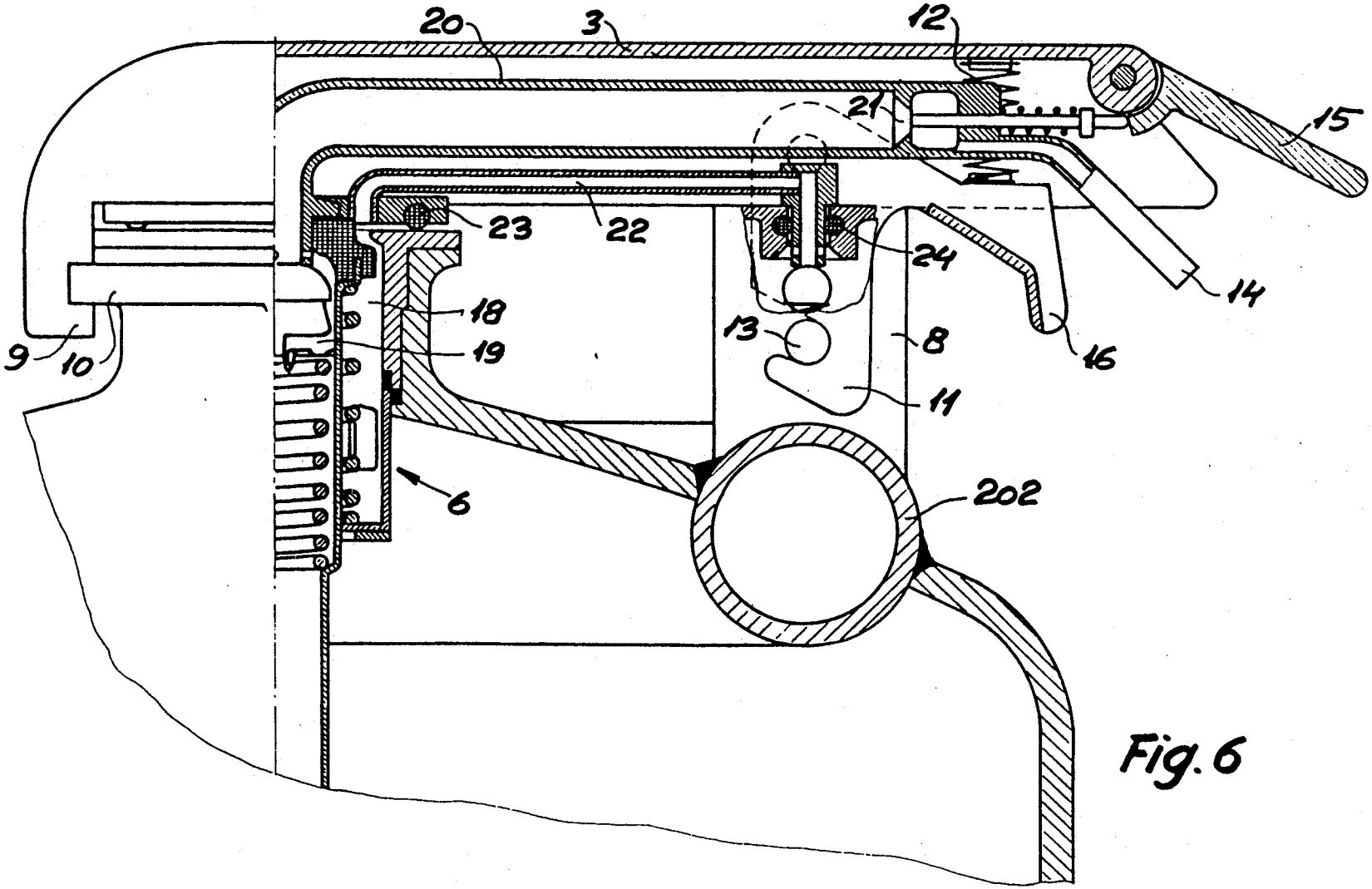
FIG. 6 is a side, partially sectionally view on an enlarged scale of a fragment of the container device according to the invention, where the connections between the coupling head and respectively the reduction valve and the combined gas and liquid valve are shown in detail.

FIG. 1 shows a first embodiment of a container device according to the invention which comprises a liquid container 1 for a beverage, e.g. beer, wine, mineral water or juice, a high pressure container 102 for a liquefied gas, e.g. $CO_2$, welded in said liquid container, as well as a mounted coupling head 3 which serves to interconnnect the liquid and high pressure containers. The liquid container 1 may be made of plastics, but is usually made of a metal, such as aluminum or stainless steel, and the high pressure container 102 may be made of a corresponding material. The liquid container 1 stands on a foot ring 4 and upwardly has a neck ring 5 in which a combined gas and liquid valve 6, which is not shown in FIG. 1 but in FIG. 6, is mounted. In this case, the high pressure container 102 is cylinder shaped and extends vertically through the liquid container 1, to which it is welded upwardly and downwardly so that the two containers 1, 102 in combination forms a firmly integrated unit.

The liquid container 1 is a low pressure container with a relatively low working pressure, e.g. 3 bar, when the container is used for beer, while the gas container is a high pressure container proper which is filled with gas through a schematically shown filling valve 7, and which, when the propellant gas is $CO_2$, is to withstand a test pressure of 190 bar. When during dispensing of the drinkable liquid the pressure in the liquid container 1 falls below the pressure to which a reduction valve 8, which is welded on the high pressure container 102, has been adjusted, the liquefied gas in it will begin to evaporate and penetrate into the liquid container 1 via the reduction valve 8, the coupling head 3 and the combined gas and liquid valve 6 to replace the gas which follows the liquid during dispensing. In addition to being a propellant gas, the gas serves to keep the beverage fresh in the container and give e.g. beer its characteristic fizzy and foaming character.

During evaporation the volume of the liquefied gas is multiplied to such an extent that even a very small amount of liquefied gas will be sufficient for emptying a whole liquid container of liquid, and the welded high pressure container 102 can therefore be constructed with relatively small dimensions so that its wall thickness will be correspondingly small and it does not restrict the useful volume of the liquid container to any noticeable degree. The transportable container of the invention therefore does not generally speaking take up more room than corresponding conventional containers, not withstanding that it itself holds and carries its own propellant gas.

High pressure containers are subjected to the rules of the authorities, which i.a. require that the container is to be pressure tested, e.g. every five years. However, this does not apply in case that the product of volume in liters and pressure in bar is below a predetermined limit value, e.g. 250 or 200, a size which may vary slightly from country to country. Since, as mentioned above, the gas container has a relatively small volume and is nevertheless able to hold the necessary gas amount, so small gas containers can normally be used that the repeated pressure testing, which will be hard and difficult to carry out with such an integrated arrangement, is not necessary. If, however, the volume should be so great in particularly large liquid containers that the above-mentioned limit value cannot be observed with one container, more gas containers are used instead according to the invention between which the gas is then distributed so that the limit value will not be exceeded by any of these containers.

Figure 2:
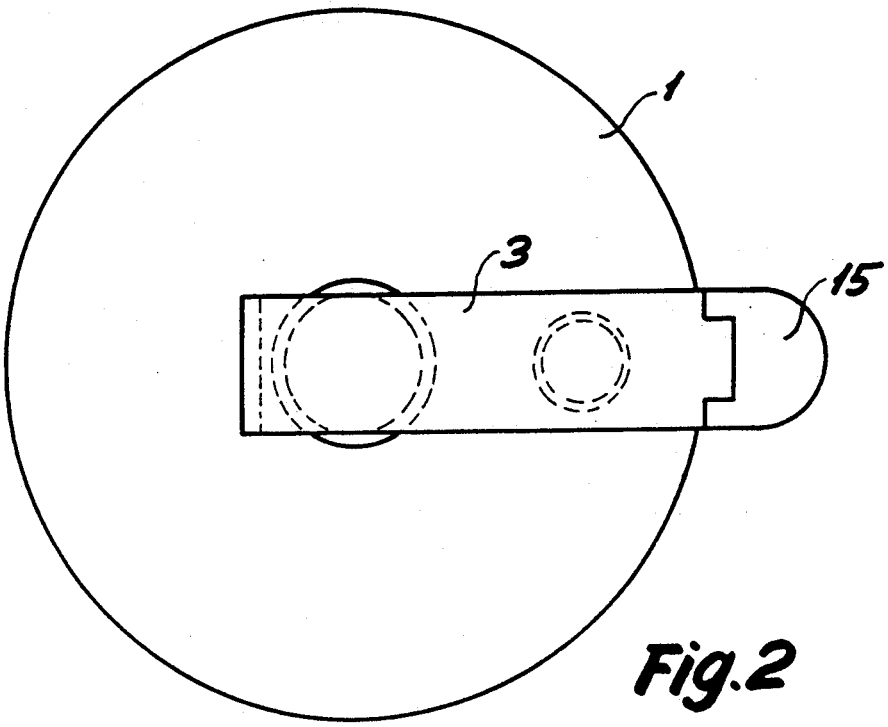
FIG. 2 is a top view of the same.
Figure 7:
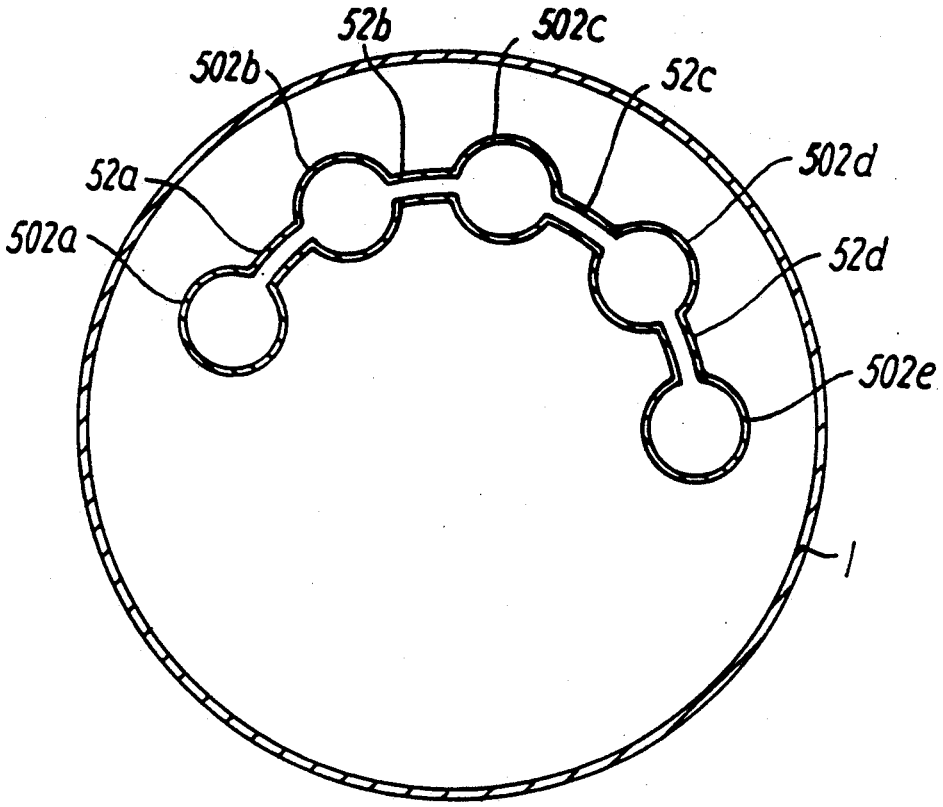
FIG. 7 is a top sectional view of a fourth embodiment of a container device of the invention.

A structure depicting multiple high pressure gas containers is shown in FIG. 7 (corresponding to the liquid container of FIG. 2) in cross-section with five cylinder-shaped high pressure containers 502*a–e* which are interconnected by tube connections 52*a–d*. One of these high pressure containers 502*a–e*, e.g., the central one, is then provided with a welded reduction valve 8 in the same manner as shown in FIG. 1, while the other high pressure containers are connected to this valve via the appropriate tube connections 52*a–d* and the intermediate high pressure containers 502*a–e*. All high pressure containers 502*a–e* thus are integrally connected to the liquid container 1 in the same manner as the high pressure container 102 shown in FIG. 1.

Figure 8:
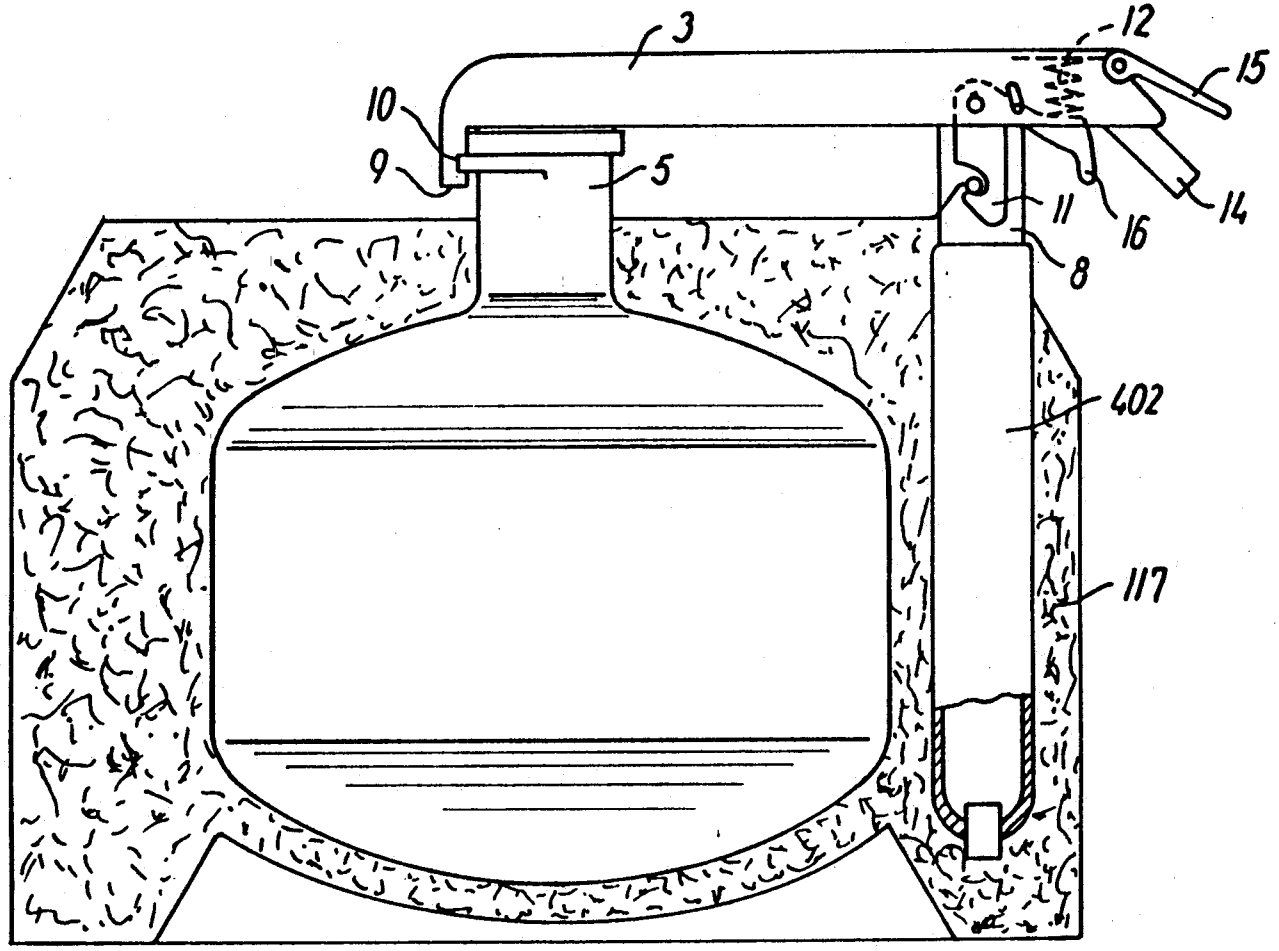
FIG. 8 is a side, partially sectional view of a fifth embodiment of a container device of the invention.
Figure 9:
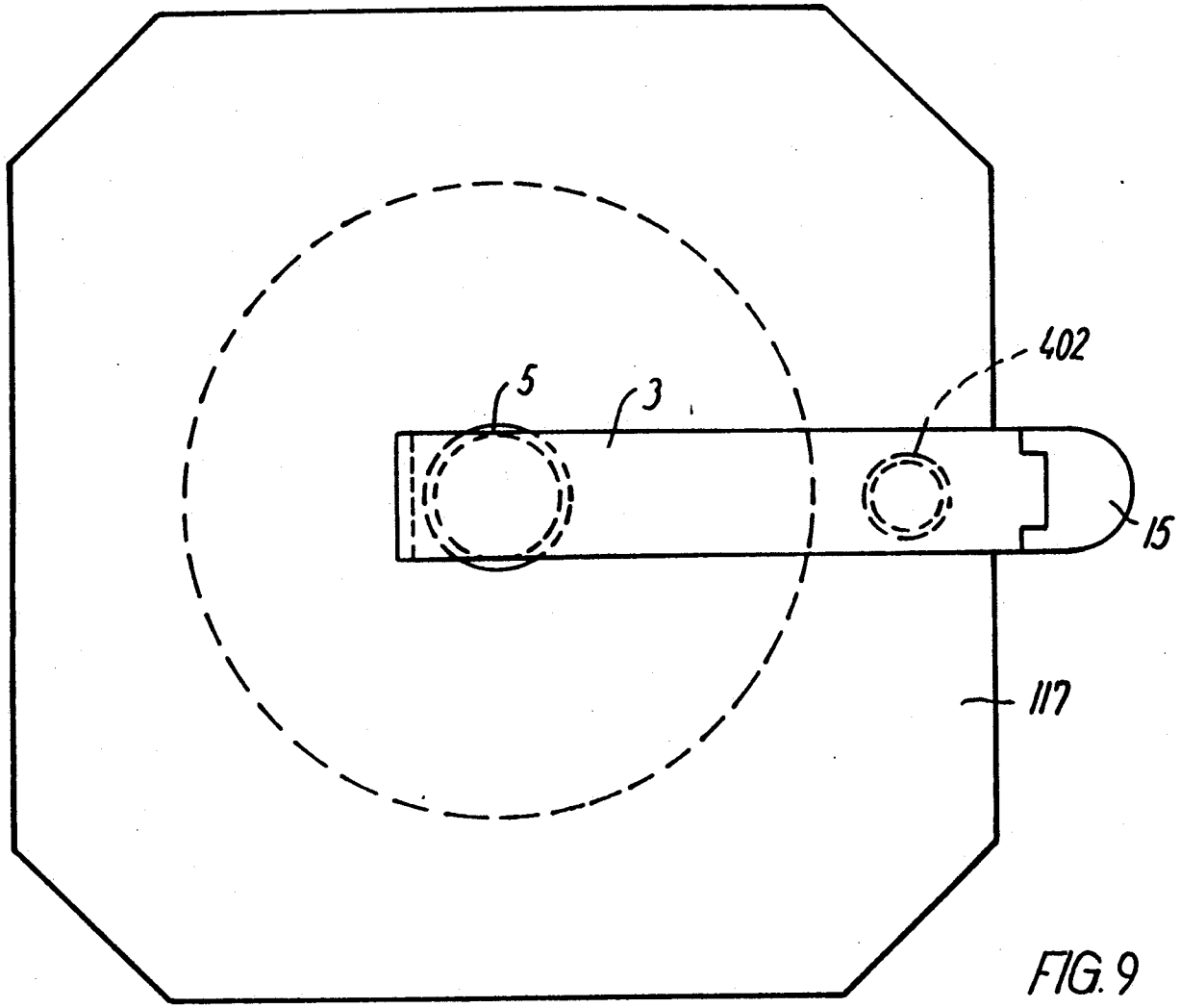
FIG. 9 is a top view of the partial sectional view of the fifth embodiment of a container device of the invention.

FIGS. 8 and 9 show a corresponding structure with a cylinder-shaped high pressure container 402 integrally imbedded in an outer jacket 117.

In the embodiment shown in FIG. 1, the reduction valve 8 is welded upwardly on the high pressure container 102, as mentioned. As shown, the coupling head 3 may be mounted in a single operation, which at the same establishes all connections, as will be explained later in connection with FIG. 6. In this case, mounting takes place by causing a hook 9 on the coupling head 3 to engage below a rearwardly facing edge 10 on the neck ring 5 and then tilting the coupling head downwardly until a detent 11 is caused to engage a pin 13, disposed on each side of the reduction valve, by means of a spring 12. The coupling head has moreover a dispensing valve 14 which can be activated by a rocker arm 15.

Mounting of this structure requires no special skills or tools and can be performed with just a single manipulation, as mentioned, whereupon the container is immediately ready for use. When the container is empty, it is dismantled merely by releasing the detent 11 by pulling a finger grip 16 provided on the detent 11.

The mechanism described above may also be arranged in many other ways within the scope of the invention. In this connection it is essential that the gas and liquid connections are established simultaneously with the mounting of the coupling head.

Figure 3:
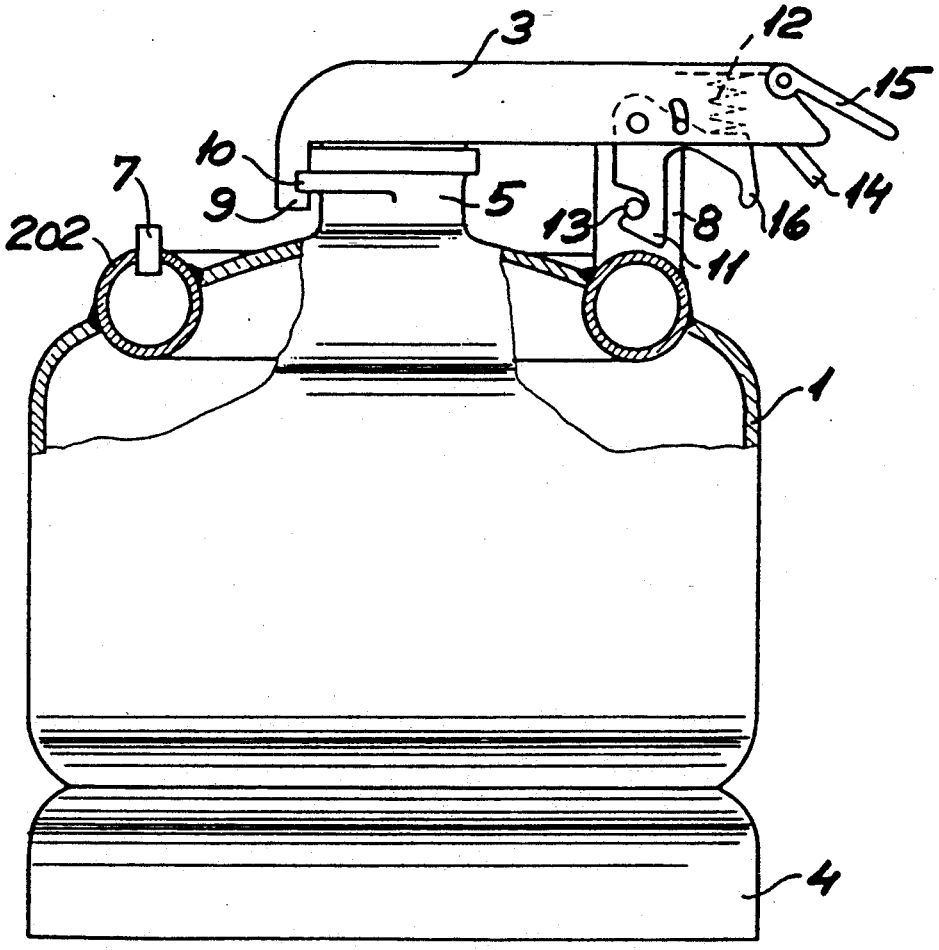
FIG. 3 is a side, partially sectionally view of a second embodiment of the container device of the invention.

The embodiment of the container device of the invention shown in FIG. 3 is quite similar to the container device shown in FIG. 1, except that in this case the gas container 202 is shaped as a ring which is welded in the top of the liquid container 1. This structure has the special advantage that the gas container 202 can obtain a sufficiently large volume with even a very small container diameter since, on the other hand, the ring itself can be provided with a large diameter corresponding to the liquid container.

In both of the cases described above the gas container or the high pressure container was welded with the liquid container. However, according to the invention, the two containers may also be joined to an integrated unit in any other suitable manner which can establish a firm connection between the two components, e.g. soldering, seaming or screwing.

Figure 4:
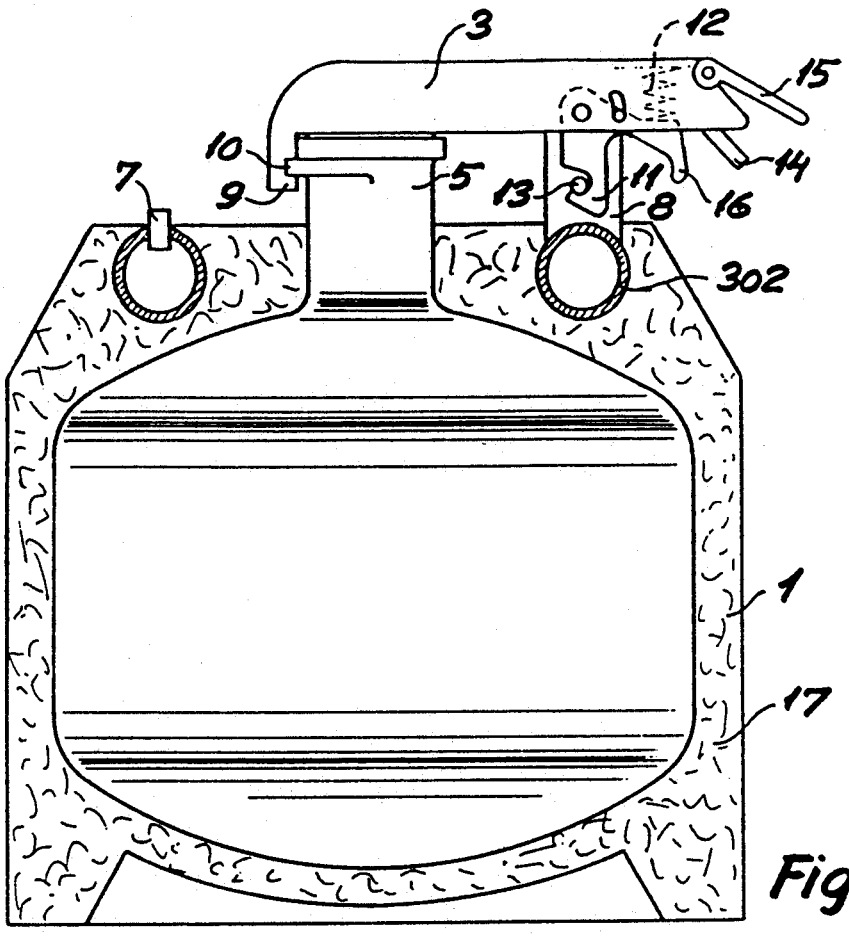
FIG. 4 is a side, partially sectionally view of a third embodiment of a container device of the invention.
Figure 5:
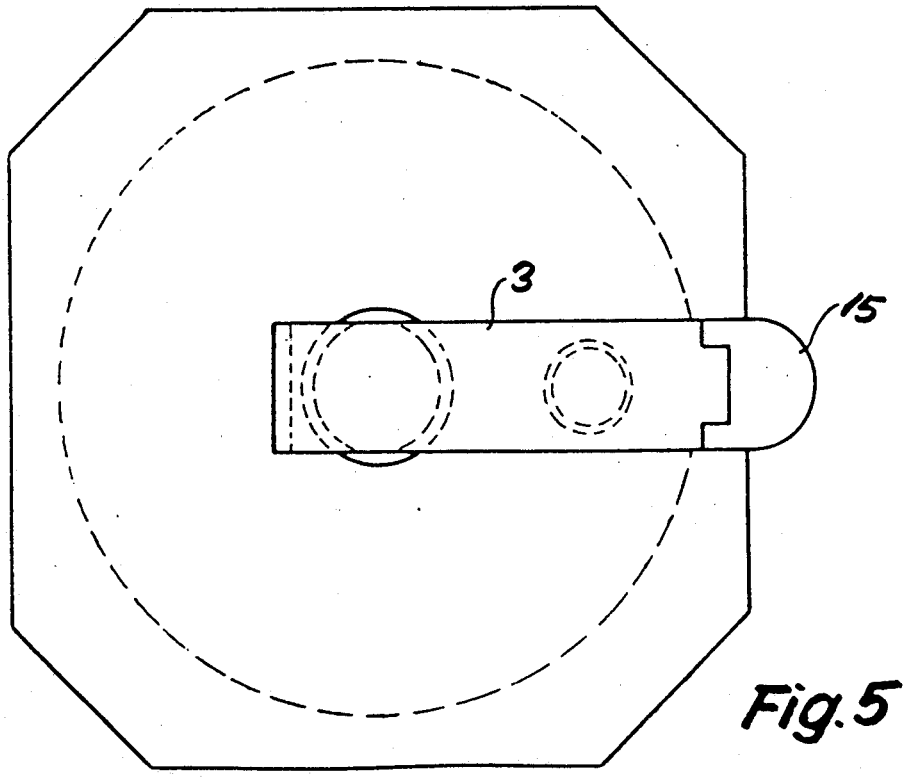
FIG. 5 is a top view of the same.

FIGS. 4 and 5 show a third embodiment of the invention where the high pressure container 302, which is ring-shaped in this case, is connected with the liquid container 1 by means of an outer jacket of e.g. foam plastics, such as foamed polyurethane which molds the two containers 1, 302 to an integrated unitary structure. Then, the gas container 302 will be disposed completely outside the space in the liquid container 1 in which the beverage container is contained. This embodiment is particularly advantageous since the internal faces of the liquid container can be cleaned more easily and more carefully than in the embodiment described before, where also the high pressure container had faces which touched the beverage. The outer jacket 17 may moreover provide the entire container device with suitable protection during transport and handling and also serve as an insulation to keep the beverage cold. Apart from the above-mentioned amendments, this structure corresponds in all its respects to the embodiment shown in FIG. 3.

FIG. 6 shows in more detail and on an enlarged scale the overall arrangement of the valve 6, the coupling head 3 and the reduction valve 8, which is welded on a ring-shaped high pressure container 202 in this case. The valve 6 is a combined gas and liquid valve which is generally called a tap and which have a gas passage 18 and a liquid passage 19, but may otherwise be of any suitable structure and will therefore not be described in detail here. Via a liquid channel 20 in the coupling head 3 the liquid passage is connected with the dispensing valve 14 which can be opened by a slight pressure on the rocker arm 15 so that a valve 21 is opened. However, the latter arrangement may also be established in many other ways, e.g. with a rotatable plug. The gas passage communicates with the reduction valve via a gas channel 22 in the coupling head 3. The structure of the reduction valve 8 is of a known type like the valve 6 and will therefore not be described more fully here.

As described before, the coupling head is mounted easily and quickly by a single manipulation, thereby providing a seal with respect to the gas and liquid valve 6 by means of an O-ring seal 23 and with respect to the reduction valve 8 by means of another O-ring seal 24. As will appear, all connections are hereby established automatically via the coupling head 3 so that the liquid container 1 is successively filled with gas from the gas container 202 as the beverage is dispensed from the valve 14.

We claim:

1. A container device for distributing a liquid under pressure from a gas, the container device comprising:

a liquid container with a combined gas and liquid valve;

at least one liquified gas high pressure container joined with the liquid container to form an integral unit, said liquified gas high pressure container having a reduction valve mounted thereto to reduce a high pressure of a gas phase coming from the at least one liquified gas high pressure container to a reduced gas pressure in the liquid container; and a coupling head detachably coupled simultaneously with both the combined gas and liquid valve and said reduction valve allowing the gas with reduced pressure from the reduction valve to pass to the liquid container via a gas passage of the combined gas and liquid valve and the liquid to be dispensed under pressure from the gas from the liquid container via a liquid passage of the combined gas and liquid valve.

2. The container device according to claim 1, wherein the at least one liquid gas high pressure container is selected from one of two container shapes, a first container shape being a cylinder and a second container shape being a donut-shape, said liquified gas high pressure container connected to the liquid container by a one of welding, soldering, seaming and screwing.

3. The container device according to claim 1, wherein the at least one liquified gas high pressure container is selected from one of two container shapes, a first container shape being a cylinder and a second container shape being a donut-shape, said at least one liquified gas high pressure container being surrounded by and embedded in a jacket of material surrounding the liquid container.

4. The container device according to claim 3, wherein the material of the jacket is foam plastic.

5. The container device according to claim 1, wherein each of said at least one liquified gas high pressure container ha sa gas pressure of not less than 60 bar and a product of the gas pressure and a volume in liters of each of said at least one liquified gas high pressure container is not greater than 250 liter-bars.

6. The container device according to claim 1, wherein the reduction valve is integrally connected to both the liquid container and the at least one liquified gas high pressure container.

7. The container device according to claim 1, wherein the coupling head includes a dispensing valve for dispensing liquid; the reduction valve defines a first axis and the combined gas and liquid valve defines a second axis spaced from and parallel to the first axis; and the coupling head is arranged to connect the reduction valve with the combined gas and liquid valve simultaneously with the connection of the dispensing valve and the combine gas and liquid valve.

8. The container device of claim 1, wherein the liquid container defines a first wall and the at least one liquified gas high pressure container defines a second wall, the first wall being distinct from the second wall such that the liquid container and the at least one liquified gas high pressure container do not share a common wall.

9. The container device of claim 1, further comprising a jacket, wherein both the liquid container and the at least one liquified gas high pressure container are fixed embedded in said jacket and portions of the jacket separate the liquid container from the at least one liquified gas high pressure container.

10. The container device according to claim 1, further comprising a jacket of material surrounding said liquid container, wherein said at least one liquified gas high pressure container is embedded in the jacket of material surrounding the liquid container separated from said liquid container.

11. The container device according to claim 10, wherein the material of the jacket is foam plastic.

* * * * *